United States Patent [19]

Jomen et al.

[11] 3,993,206

[45] Nov. 23, 1976

[54] POWER SLIDE MECHANISM

[75] Inventors: Katsumasa Jomen; Keitaro Sunaga, both of Sagamihara, Japan

[73] Assignee: Mitsubishi Jukogyo Kabushiki Kaisha, Tokyo, Japan

[22] Filed: Nov. 8, 1974

[21] Appl. No.: 522,289

[30] Foreign Application Priority Data

Feb. 8, 1974 Japan ..... 49-15405

[52] U.S. Cl. ..... 214/138 C; 37/103; 92/117 R; 92/118; 254/93 R; 280/456 R; 280/468

[51] Int. Cl.[2] ..... E02F 5/02; F15B 15/00

[58] Field of Search ..... 280/456 R, 468–471; 92/117–119; 37/1, 103; 254/84, 93 R, 105, 106; 214/768, 138 C

[56] References Cited

UNITED STATES PATENTS

| | | | |
|---|---|---|---|
| 2,657,009 | 10/1953 | Neis et al. | 92/117 R |
| 2,938,706 | 5/1960 | Langen | 92/117 R X |
| 3,019,923 | 2/1962 | Morrison et al. | 37/103 X |
| 3,155,250 | 11/1964 | French et al. | 214/138 C |
| 3,202,000 | 8/1965 | Fischer | 92/117 R X |
| 3,244,301 | 4/1966 | Vaughan | 214/138 C |
| 3,298,547 | 1/1967 | Williams | 37/103 X |
| 3,326,524 | 6/1967 | Taylor | 254/93 R X |
| 3,339,941 | 9/1967 | Braunberger | 92/117 R X |
| 3,371,435 | 3/1968 | Miller | 37/1 X |
| 3,388,928 | 6/1968 | Poker et al. | 280/456 R |
| 3,390,793 | 7/1968 | McMullen | 214/138 C |
| 3,486,737 | 12/1969 | Campbell | 254/106 |
| 3,531,007 | 9/1970 | Leijon | 214/768 |
| 3,796,276 | 3/1974 | Maeda | 254/84 X |
| 3,885,694 | 5/1975 | Uchida | 214/768 |

FOREIGN PATENTS OR APPLICATIONS

| | | | |
|---|---|---|---|
| 1,117,057 | 4/1956 | Germany | 37/103 |
| 896,000 | 5/1962 | United Kingdom | 37/103 |

OTHER PUBLICATIONS

B382,840, Jan. 1975, Friedebach, 280/456 R.

*Primary Examiner*—Edgar S. Burr
*Assistant Examiner*—Steven A. Bratlie
*Attorney, Agent, or Firm*—Cushman, Darby & Cushman

[57] ABSTRACT

An elongated, generally horizontal frame is provided with latch means at each end. An equipment mounting frame is mounted on the elongated frame for movement to selected positions therealong from adjacent one end to adjacent the other end of the elongated frame; a hydraulic cylinder is pivotally mounted on the equipment mounting frame, about a generally horizontal axis proceeding transversally. Piston rods extend in opposite axial directions from a piston slidingly received in the cylinder. Cooperating latch means are provided on the outer ends of the two piston rods. The equipment mounting frame is moved along the elongated frame by latching one piston rod end or the other in one of the latch means of the elongated frame and applying hydraulic fluid to the cylinder to relatively extend or retract the latched piston rod. Latching and unlatching are accomplished by temporarily tilting the cylinder from horizontal (e.g. left end down, right end up) about the cylinder pivot mounting sufficiently to engage or disengage the respective latch means. Typically, the generally horizontal frame is provided at the rear of a tractor and an excavating back hoe is mounted on the equipment mounting frame.

6 Claims, 17 Drawing Figures

POWER SLIDE MECHANISM

This invention relates to a power slide mechanism for moving a movable mast frame and more particularly but not exclusively it relates to an excavating device mounted on a movable mast frame on a construction machine provided with such a power slide mechanism.

Heretofore, when carrying out excavation of a side channel use has been made of an excavating device mounted on a construction machine. The excavating device has been in general suspended from a supporting frame and positioned on two parallel straight beams secured to the chassis of the machine by means of projections such as pawls in order to permit shifting the excavating device relative to the chassis of the construction machine. The excavating device has been integrally secured to the supporting frame by means such as bolts.

Therefore, when the excavating device is to be shifted, the excavating device must be loosened from the supporting frame by loosening the bolts and the excavating device shifted by a force provided by the excavating device itself or by an external power. Consequently the operation is troublesome and it is difficult to carry out smoothly the shifting of the excavating device. Furthermore there is the disadvantage that the excavating work must be interrupted.

FIGS. 1 and 2 illustrate a power slide mechanism known to the Applicants in Japan. The mechanism comprises a mounting plate *c* which is horizontally shiftably mounted on horizontal beams *b* of supporting frame *a*. An excavating device *d* such as a back hoe is integrally secured to the mounting plate *c* and is actuated by oil pressure actuated cylinder *e*. The cylinder *e* is secured to the supporting frame *a*. Consequently it is impossible to use effectively the whole length of the supporting frame *a* and the range of shifting of the mounting plate *c* is limited to one side of the supporting frame *a* as shown in FIG. 1. Furthermore, in order to ensure sufficient range of shifting, the cylinder *e* must project to a considerable extent beyond the supporting frame, *a* as shown in FIG. 2, which gives rise to disadvantages.

The Applicants are also aware of an apparatus illustrated in FIGS. 3 to 6, wherein a piston rod *f* of the oil pressure cylinder *e* is integrally secured to one end *g* of the supporting frame *a* and the mounting plate *c* mounting the excavating device (not shown) is selectively connected by means of pins *i* to either one of two connecting pieces *h* provided at each end of the oil pressure cylinder *e*. However, while this arrangement permits the excavating device to slide over a range about twice the stroke of the oil pressure cylinder *e*, the pins *i* cannot be inserted into respective holes in the mounting plate *c* and the connecting pieces *h* until after the holes are aligned with each other. Therefore, in the field and particularly in difficult conditions, the above-described operation is difficult and time-consuming.

According to the present invention there is provided a power slide mechanism for moving a movable mast frame adapted to be mounted on an elongate frame having arresting brackets at either end thereof, which mechanism comprises:

1. the movable mast frame adapted to be mounted on the elongate frame;

2. a hydraulic cylinder pivotally mounted on the movable mast frame so that the cylinder can be inclined in a clockwise or anti-clockwise direction;
3. a movable piston situated in the hydraulic cylinder;
4. two piston rods each connected to the piston, one rod projecting from one end of the hydraulic cylinder and the other rod projecting from the other end of the hydraulic cylinder;
5. means for varying the inclination of the cylinder; and
6. means at the end of each piston rod for cooperating with the arresting brackets to hold the end of a piston rod in such a manner that in operation the cylinder can be moved relative to the piston and the end of the piston rod can be freed from the arresting bracket by varying the inclination of the cylinder.

The elongate frame may be on a construction machine and an excavating device may be secured to the movable mast frame.

In operation, the end of one of the piston rods is held in an arresting bracket at one end of the alongate frame. Oil under pressure can be provided to the hydraulic cylinder to move the cylinder, and hence the frame and the excavating device, by an amount equal to the stroke of the cylinder and extending from the mid-point of the elongate frame towards the arresting bracket holding the end of the piston rod. The movable mast frame can be positioned anywhere over a distance equal to the stroke of the cylinder and extending from the mid-point towards one end of the elongate frame. If it is desired to move the movable mast frame to the other end of the movable mast frame, the following steps are carried out;

1. the cylinder is moved to its maximum distance from the arresting bracket holding the end of a piston rod, i.e. to the mid-point of the elongate frame;
2. the cylinder is rotated clockwise or anti-clockwise to incline it and raise the end of the latched piston rod clear of the arresting bracket;
3. the piston is shifted in the cylinder so that the other piston rod slides along a guide portion of the arresting bracket at the other end of the elongate frame until it is held by that arresting bracket. Until the end of the piston rod is held in the arresting block, the weight of the movable mast frame and the excavating device is sufficient to ensure that when oil under pressure is supplied to the hydraulic cylinder, the piston, not the cylinder, moves.

Once these steps have been carried out, the movable mast frame can be positioned anywhere over a distance equal to the stroke of the cylinder and extending from the mid-point towards the other end of the elongate frame.

The inventon will be further illustrated with reference to FIGS. 7 to 15 of the accompanying drawings showing, by way of example, a power slide mechanism in accordance with the invention, in which.

Figure 1:
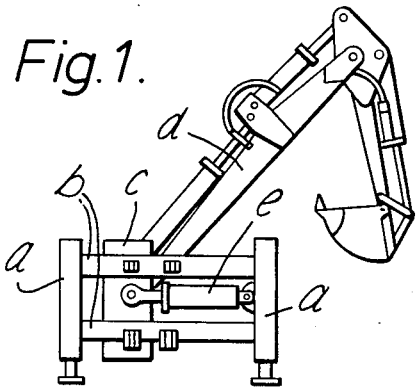
Figure 2:
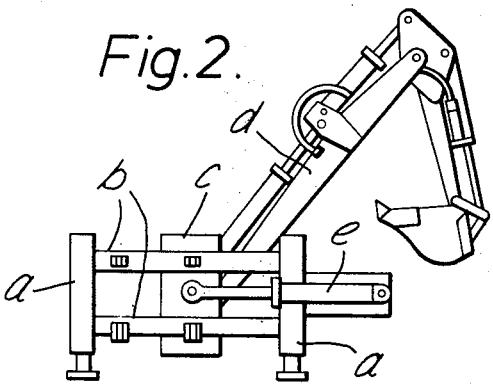
Figure 3:
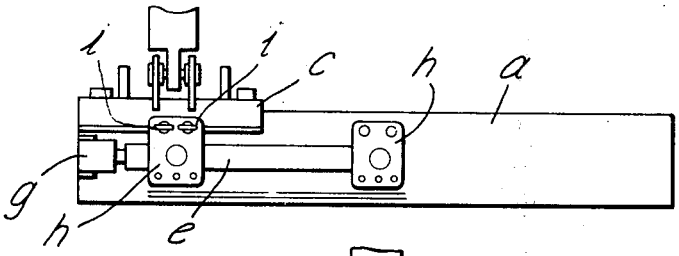
Figure 4:
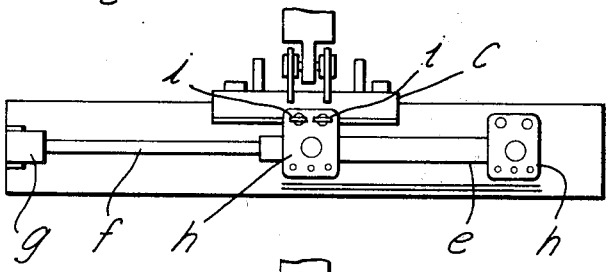
Figure 5:
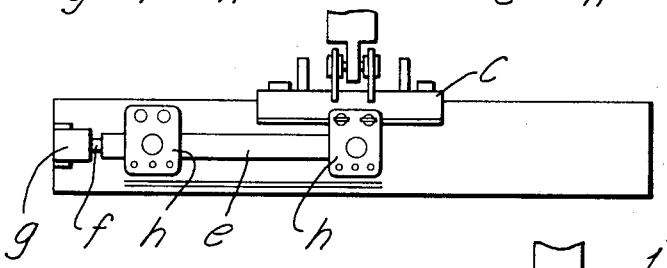
Figure 6:
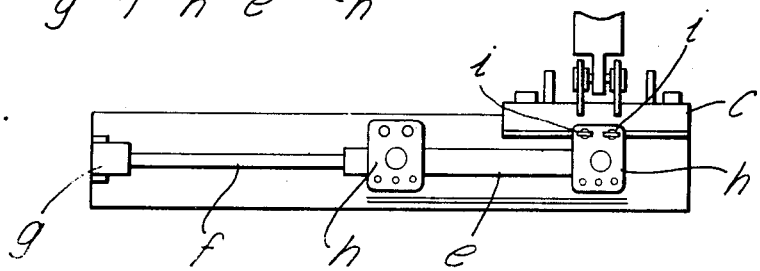
Figure 7:
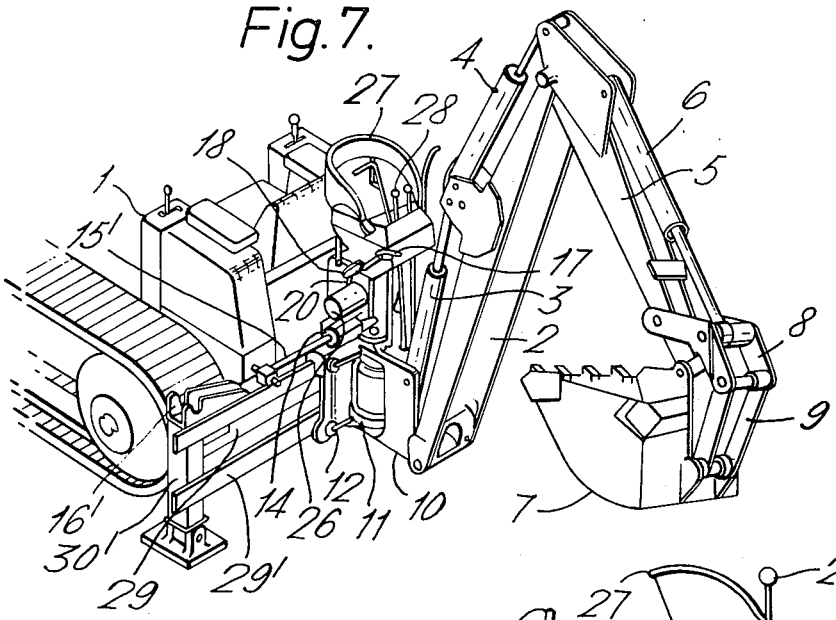
FIG. 7 is a perspective view of the power slide mechanism of the excavating device.
Figure 8:
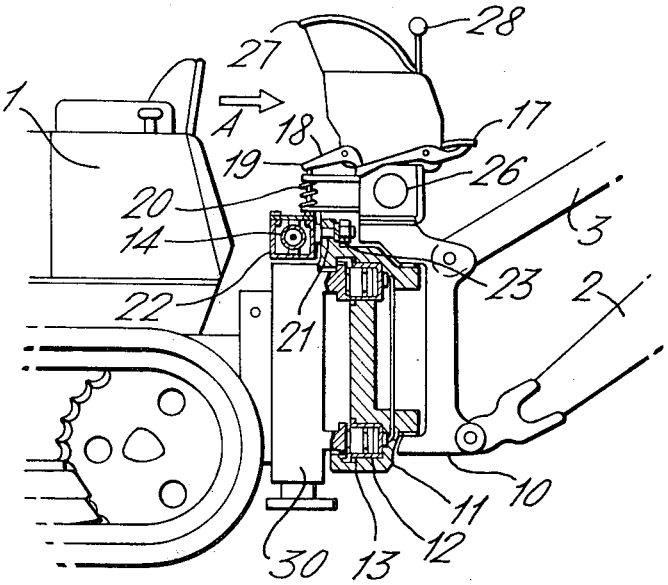
FIG. 8 is a side view thereof.

Referring to FIG. 7, 1 designates a main body of a tractor provided with a back hoe device described below. One end of a boom 2 is vertically swingably connected to a swing post 10 of the main body 1 of the tractor, the boom 2 being freely swung vertically by a boom cylinder 3.

An arm 5 pivoted at the tip of the boom 2 is adapted to be swung upwards and downwards by dip stick cylinder 4. A bucket 7 is pivoted at the tip of the arm 5 and is adapted to be actuated by bucket cylinder 6 through driver link 8 and coupler link 9.

The swing post 10 is connected by a vertical pin to a mast frame 11 shiftably mounted on an elongate frame comprising two horizontal, parallel supporting frame members 29, 29′ which are integrally secured to the main body 1 of the tractor. The mast frame 11 is provided with four sets of lock cylinders 12 and pistons 13 for locking the mast frame 11 to the supporting frame member 29, 29′. An operator seat 27, operating levers 28 for the control valves of the excavating device and rack-pinion device 26 for turning the excavating device are provided on the swing post 10.

A cylinder 14 is integrally mounted on a frame 22 which is pivotally mounted on the mast frame 11 by means of pin 21 and nut 23 so that the inclination of the cylinder can be varied. The tips of piston rods 15, 15′ projecting from opposite ends of the cylinder 14 are so shaped that they can be guided by guide portions of arresting brackets 16, 16′ integrally secured to outriggers 30, 30′ arranged at opposite ends of the supporting frame members 29, 29′ so that the tips can fit in the grooves in the arresting brackets 16, 16′.

Operating pedals 17, 17′ are provided in front of and below the operator seat 27. The pedals 17, 17′ are adapted to transmit movement through intermediate links 18, 18′ to rods 19, 19′. Either one of the rods 19, 19′ is lowered against the resilient force of springs 20, 20′ by depressing the appropriate one of the pedals 17, 17′ so that one of plates 24, 24′ attached to the cylinder 14 is depressed, thereby inclining the cylinder 14 in either rotational direction.

Numerals 25 and 25′ designate outlet and inlet ports for use in the supply of oil to and from the cylinder 14.

Figure 9:
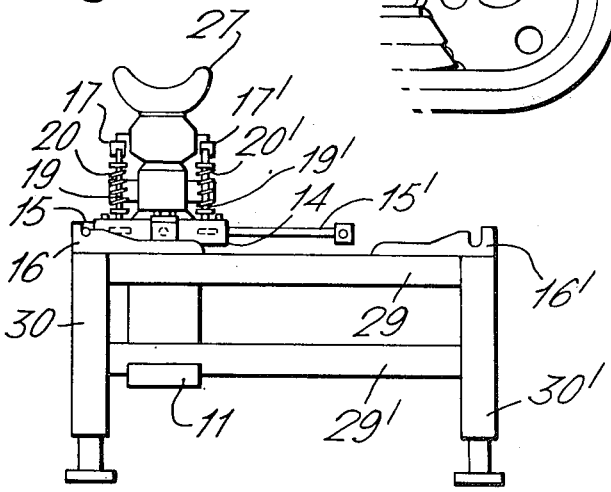
FIGS. 9 to 12 are views in the direction of arrow A in FIG. 8.
Figure 10:
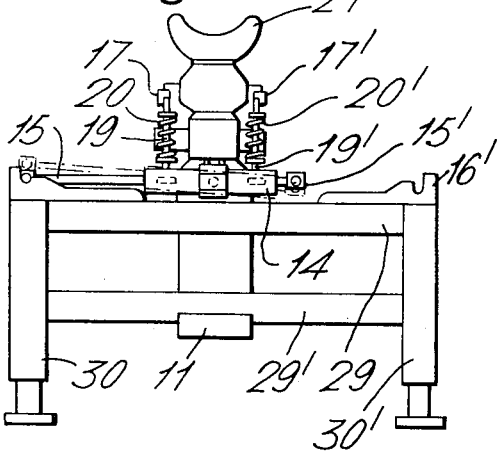

When the device is positioned at the left-hand and of the supporting frame members 29, 29′, as shown in FIG. 9 the tip of the left-hand piston rod 15 is engaged in the groove in the left-hand arresting bracket 16. The right-hand piston rod 15′ is free. When oil is introduced into the right-hand port 25′, the oil pressure cylinder 14 is moved to the right, together with the mast 11 connected to the cylinder by the pin 21, by an amount equal to the entire stroke of the cylinder 14, i.e., half the amount of the entire sliding length of the cylinder 14, so that the cylinder stops at the position shown in FIG. 10.

Then, when the right-hand pedal 17′ is depressed, the cylinder 14 is temporarily inclined in the clockwise direction (as viewed in rear elevation) about the pin 21 so that the tip of the left-hand piston rod 15 disengages from the groove of the arresting bracket 16.

Figure 11:
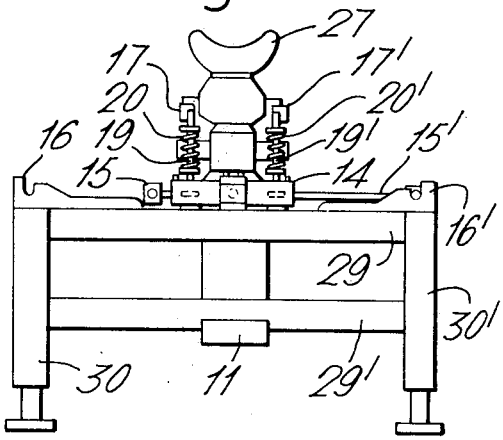

Under such conditions, if oil under pressure is fed to the left-hand port 25, the rods 15, 15′ are moved to the right along the guide portions of the bracket 16. The cylinder 14 is held stationary, because the ends of the rods 15, 15′ are both free and the load to the mast frame 11 and the back hoe device connected to the cylinder 14 is great. Consequently, the tip of the right-hand rod 15′ falls into the groove of the arresting bracket 16′ and assumes the position shown in FIG. 11 in which it is secured to the supporting frames 29, 29′.

Figure 12:
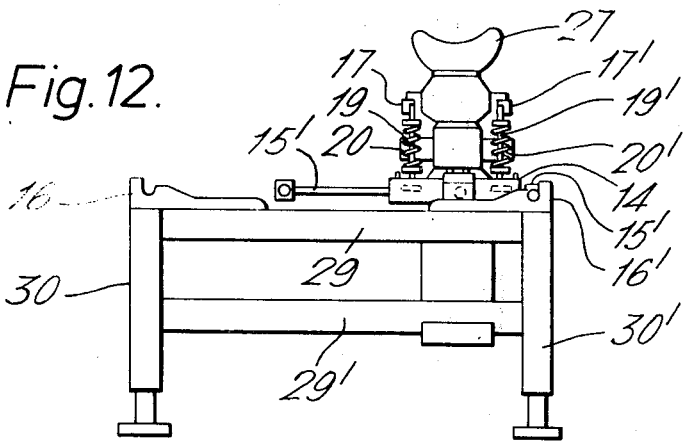
Figure 13:
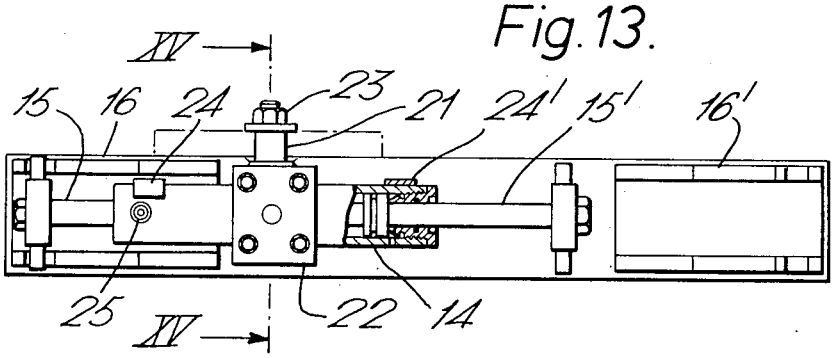
FIG. 13 is an enlarged plan view showing the main parts illustrated in FIGS. 9 to 12.
Figure 14:
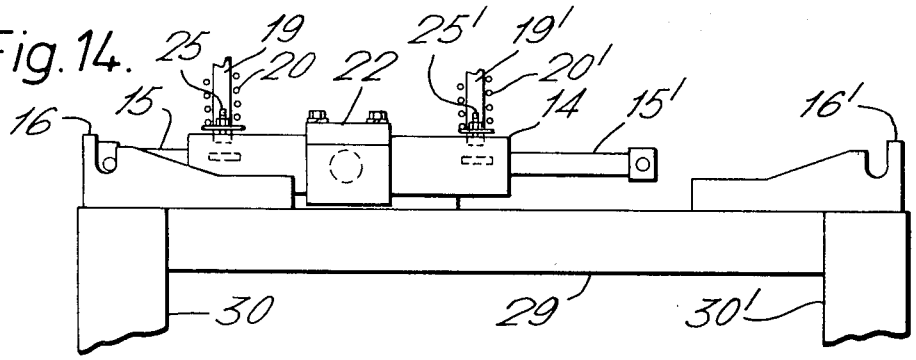
FIG. 14 is a front view showing the main parts, illustrated in FIGS. 9 to 12.
Figure 15:
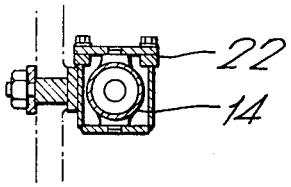
FIG. 15 is a cross-sectional side view along line XV—XV in FIG. 13.

Thereafter, if oil under pressure is again fed to the right-hand port 25′, the cylinder 14 is moved to the right together with the mast frame 11 so that the entire sliding operation of the back hoe device from the left-hand end to the right-hand end is completed as shown in FIG. 12.

Sliding of the back hoe device from the right-hand end to the left-hand end of the frame members 29, 29′ can be effected in similar manner.

As described above, in this embodiment the oil pressure cylinder 14 which serves as an actuator is constructed so that it is connected to the mast frame by means of the trunion system and can be inclined by the pedals 17, 17′ and the links 18, 18′. The rods 15, 15′ projecting from the opposite ends of the cylinder 14 are selectively engaged and secured in the groove of either of the arresting brackets 16, 16′ at the left- and right-hand ends. Consequently the cylinder 14 has a range of movement corresponding to twice its stroke. Therefore, it is possible to move the back hoe device positively and easily over the entire width of the main body of the tractor by very simple operations without requiring the oil pressure cylinder 14 to project to the side of the back hoe frame and the entire device can be made compact.

Since no specific cylinder is required and the construction is simple, it is made very inexpensive.

Figure 16:
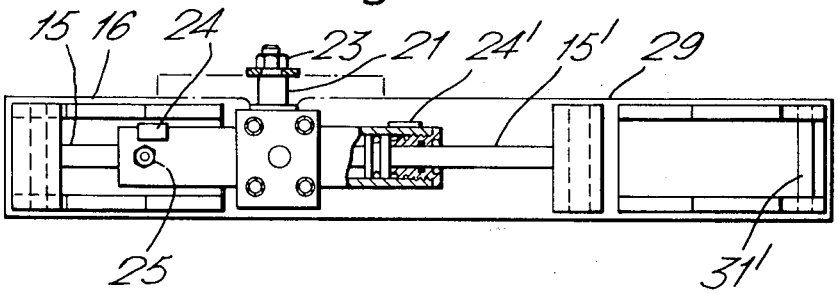
FIG. 16 is a plan view showing the main portions of another embodiment.
Figure 17:
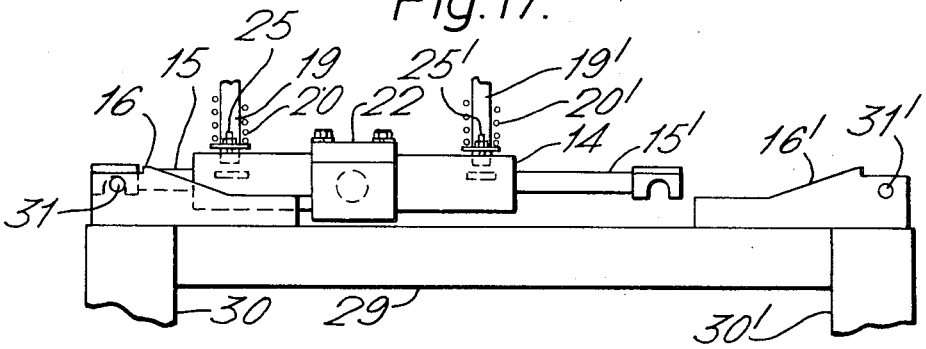
FIG. 17 is a front view of the embodiment shown in FIG. 16.

In the above described embodiment, a pin is provided at a right angle to each of the tips of the rods 15, 15′. Alternatively, as shown in FIGS. 16 and 17, pins 31, 31′ may be provided in the brackets 16, 16′, respectively, while grooves or hooks engageable with the pins 31, 31′, respectively, are formed in the tip of each of the rods 15, 15′. Either way, the rod ends are provided with latching or securement means that are cooperable with latching or securement means 16, 16′ on the ends of the frame.

What is claimed is:

1. A power slide mechanism, comprising:

an elongated, generally horizontal frame having a left end and a right end;

latch means provided at each end of the elongated frame;

an equipment mounting frame mounted on the elongated frame for movement generally horizontally therealong parallel to the sense of elongation of the elongated frame from adjacent one end to adjacent the other end of the elongated frame;

a hydraulic cylinder having a piston slidably received therein and a piston rod extending from each end of the hydraulic cylinder, the aggregate length of the piston and two piston rods being less than the distance between the two latch means on the elongated frame;

generally horizontal, transversally extending pivot means pivotally mounting the hydraulic cylinder, generally horizontally on the equipment mounting frame parallel to the sense of elongation of the elongated frame, so that one piston rod thereof extends leftwards and the other extends rightwards;

cooperating latch means provided at the outer ends of the two piston rods, for latching with and unlatching from the respective latch means at the left and right ends of the elongated frame;

means for selectively applying hydraulic pressure to either side of the piston to relatively extend one piston rod and correspondingly retract the other piston rod, and vice versa; and means for temporarily tilting the cylinder sufficiently from horizontal to disengage respective elongated piston rod end cooperating latch means from the respective frame end latch means.

2. The power slide mechanism of claim 1, further comprising:

a vehicle bearing the elongated, generally horizontal frame;

an operator station on the vehicle; and spring means applied between the vehicle and the cylinder to normaly maintain the cylinder in a generally horizontal position; and wherein said tilting means comprises means accessible from the operator station for applying force to the cylinder generally vertically, distally of the pivot means, to temporarily pivot the cylinder against a restoration force generated by consequent resilient distortion of the spring means.

3. The power slide mechanism of claim 2, wherein:

the tilting means includes a pair of foot pedals pivotally mounted on the vehicle for accessibility from the operator station and linkages connecting each foot pedal to the cylinder on opposite sides of the pivot means, so that when one said foot pedal is depressed said force is applied by the respective linkage to the cylinder on one side of the pivot means and when the other said foot pedal is depressed, said force is applied by the respective linkage to the cylinder on the other side of the pivot means.

4. The power slide mechanism of claim 2, further comprising:

a back hoe boom having one end pivotally mounted on said equipment mounting frame.

5. The power slide mechanism of claim 1, wherein:

the latch means on the elongated frame comprise respective vertically opening notch means; and the cooperating latch means on the piston rods comprise respective pins extending generally parallel to the horizontal axis of the pivot means.

6. The power slide mechanism of claim 1, wherein:

the latch means on the elongated frame comprise respective pins extending generally parallel to the horizontal axis of the pivot means, and the cooperating latch means on the piston rods comprise respective vertically opening notch means.

* * * * *